US008099864B2

(12) United States Patent
Yamamoto et al.

(10) Patent No.: US 8,099,864 B2
(45) Date of Patent: Jan. 24, 2012

(54) TIE, TIE ASSEMBLY, AND TIE ATTACHMENT DEVICE

(75) Inventors: Naoyuki Yamamoto, Kanagawa (JP); Ryouhei Yamamoto, Kanagawa (JP)

(73) Assignee: Fumoto Giken Co., Ltd., Miura-gun (JP)

( * ) Notice: Subject to any disclaimer, the term of this patent is extended or adjusted under 35 U.S.C. 154(b) by 1299 days.

(21) Appl. No.: 11/800,277

(22) Filed: May 4, 2007

(65) Prior Publication Data

US 2008/0271406 A1 Nov. 6, 2008

(51) Int. Cl.
*B23Q 7/00* (2006.01)

(52) U.S. Cl. ..... 29/811.2; 29/789; 29/270; 29/450; 52/854

(58) Field of Classification Search ..... 29/222, 29/229, 270, 450, 789, 811.2; 52/685, 686, 52/854, 857

See application file for complete search history.

(56) References Cited

U.S. PATENT DOCUMENTS

| | | | | |
|---|---|---|---|---|
| 3,200,488 | A * | 8/1965 | Johansson | 29/453 |
| 3,324,538 | A * | 6/1967 | Christensen | 29/814 |
| 3,623,635 | A * | 11/1971 | Erdmann | 221/23 |
| 3,742,577 | A * | 7/1973 | Buttriss | 29/811.2 |
| 3,789,480 | A * | 2/1974 | Iyengar et al. | 29/564.6 |
| 4,261,098 | A * | 4/1981 | Lincoln | 29/809 |
| 6,067,706 | A * | 5/2000 | Sato | 29/809 |
| 6,539,619 | B2 * | 4/2003 | Hakala | 29/814 |

FOREIGN PATENT DOCUMENTS

| | | | |
|---|---|---|---|
| JP | 1977-3290 | Y | 1/1977 |
| JP | 1979-16214 | U | 2/1979 |
| JP | S60-87930 | | 6/1985 |
| JP | S61-020625 | | 2/1986 |
| JP | 1988-33224 | A | 2/1988 |
| JP | 1991-24551 | U | 3/1991 |
| JP | 1992-62715 | U | 5/1992 |
| JP | 1992-108717 | U | 9/1992 |
| JP | 1992-130308 | U | 11/1992 |
| JP | 2005-232866 | A | 9/2005 |
| JP | 2005-320816 | | 11/2005 |

OTHER PUBLICATIONS

Web page, http://www9.ocn.ne.jp/~tairiku/PicHomePage0/vw_7.html.

* cited by examiner

*Primary Examiner* — David Bryant
*Assistant Examiner* — Christopher Koehler
(74) *Attorney, Agent, or Firm* — Masuvalley & Partners

(57) ABSTRACT

The present invention provides a reinforcing bar tie the enables the connection intersecting reinforcing bars. The invention houses a tie made of an elastic member in a reception space, and extrudes it with an extruding member. At this time, the curved portions provided on both ends of the tie advance while guiding portions of a guiding member push them open, and are guided to an intersecting position of two reinforcing bars. Further, by extruding with the extruding member the tie detaches from the guiding member and winds around the intersection of the two reinforcing bars with a force sufficient to couple the two reinforcing bars together.

4 Claims, 11 Drawing Sheets

TIE, TIE ASSEMBLY, AND TIE ATTACHMENT DEVICE

TECHNICAL FIELD

The present invention relates to a tie for binding materials to be tied such as reinforcing bars, a tie assembly, and a tie attachment device.

BACKGROUND OF INVENTION

Conventionally, reinforcing bars are arranged inside of concrete columns and walls in reinforced concrete buildings. For example, in a reinforced concrete column, a plurality of reinforcing bars are arranged along the direction of the column, and reinforcing bars are further arranged in horizontal direction intersecting with the reinforcing bars in a horizontal direction. Such reinforcing bars are installed prior to pouring concrete in a framework and an intersectional portion of the reinforcing bar in the vertical direction (vertical reinforcement) and the reinforcing bar in the horizontal direction (horizontal reinforcement) are fixed by twisting a wire. Such procedure of twisting wires takes time and effort, thus connection and fixation tools for fixing intersectional reinforcing bars and devices for twisting wires have been proposed, as follows:

[Patent document 1] Japanese Published Unexamined Patent Application No. 2005-320816;

[Patent document 2] Japanese Published Unexamined Utility Model Application No. S60-87930;

[Patent document 3] Japanese Published Unexamined Utility Model Application No. S61-20625; and

[Non-patent document 1] Binding machine http://www9.ocn.ne.jp/tairiku/PicHomePage0/vw 7.html

BRIEF SUMMARY OF THE INVENTION

However, while the conventional connecting tools described above save the effort of twisting wire for binding, it is bulky for preparing large amounts because the ties are in complicated forms. For this reason, it is inconvenient to carry. Also, there is a problem of difficulty in the attachment work.

Further, the binding machine described in non-patent document 1 is a device having a motor driven by electricity and binds reinforcing bars by twisting wires around, however, the machine is not suitable for working for a long time due to its large weight, and there is a problem of a further increase of the weight when a battery is used because the power wire supplying electricity disturbs the work.

The present invention has been made in consideration of these issues, and it is therefore an objective of the present invention to: 1) provide a reinforcing bar tie which connects intersectional reinforcing bars; 2) provide a tie assembly that connects a plurality of ties for easy attachment; and 3) provide a tie attachment device for each attachment to the intersectional portion of the reinforcement bars.

The objectives are achieved by the present invention described as below.

(1) A tie for twisting around at an intersectional portion of a plurality of materials to be tied to bind these materials, wherein the tie consists of a wire rod made of elastic material formed in an arc, where the clearance between both ends is larger than the minimum width of the bound portion of material to be tied when both ends are opened within an elastic deformation range, and the maximum inner diameter in a restored state is smaller than the maximum width of the bound portion of materials to be tied.

(2) The tie according to (1) above, wherein the tie is for binding a pair of materials to be tied.

(3) The tie according to (2) above, wherein an intersectional portion of crossed material to be tied is a bound portion.

(4) The tie according to (2) above, wherein the bound portion is a portion of overlap of materials to be tied which are arranged in parallel.

(5) The tie according to any one of (1) to (4) above, wherein both ends of said arc wire rod have curved portions curving opposite to the direction of the curve of the arc.

(6) The tie according to any one of (1) to (5) above, wherein said wire rod has a rupture portion to be ruptured when a deformation value exceeds an elasticity limit.

(7) The tie according to (6) above, wherein said rupture portion is provided on the midsection of an axial direction of said wire rod.

(8) The tie according to (6) or (7) above, wherein said rupture portion is a portion smaller in area of cross-section of said wire rod than another portion.

(9) The tie according to (8) above, wherein said rupture portion is a groove or a cut formed in a direction perpendicular to the axial direction of said wire rod.

(10) The tie according to one of any (1) to (9) above, wherein a portion of both end portions of said wire rod is crossing in a restored state.

(11) The tie according to one of any (1) to (10) above, wherein said wire rod having one, or two or more loops formed in an arc as an overall shape and a portion is configured by curving outward.

(12) A tie assembly for connecting an inserting member inserted between both ends of a tie through a thin walled connecting portion, wherein the tie consists of a wire rod made of elastic material formed in an arc, the clearance between both ends is larger than the minimum width of the bound portion of material to be tied when both ends are opened within an elastic deformation range, and the maximum inner diameter in a restored state is smaller than the maximum width of the bound portion of material to be tied.

(13) A tie attachment device consisting of;

a guiding member positioned between both ends of a tie for guiding to a direction, wherein a tie consists of a wire rod made of elastic material formed in an arc, the clearance between both ends is larger than the minimum width of the bound portion of material to be tied when both ends are opened within an elastic deformation range, and the maximum inner diameter in a restored state is smaller than the maximum width of the bound portion of material to be tied;

a storing portion positioned between said guiding member for storing the material to be tied;

an extruding member positioned posterior to said guiding member for extruding a tie forward; and an operation means for advancing said extruding member;

wherein said extruding member is capable of reciprocal motion between a standby position forming a reception space to house a tie between said guiding member, and an attachment position where both ends of a tie exceeding the frond end of the guiding member.

(14) The tie attachment device according to (13) above, wherein a groove for guiding both end portions of the tie is formed on an outer face of said guiding member.

(15) The tie attachment device according to (13) or (14) above, wherein the tie attachment device for feeding a tie to a reception space has a reception portion between said guiding member and said extruding member.

(16) The tie attachment device according to (15) above, wherein a tie assembly is housed in said reception portion, wherein the tie assembly connects an inserting member inserted between both ends of a tie through a thin walled connecting portion, and the tie consists of a wire rod made of elastic material formed in an arc, the clearance between both ends is larger than the minimum width of the bound portion of material to be tied when both ends are opened within an elastic deformation range, and the maximum inner diameter in a restored state is smaller than the maximum width of the bound portion of material to be tied; and a biasing member is provided in said reception portion for biasing said tie assembly to the reception space.

(17) The tie attachment device according to one of any (13) to (16) above, wherein said operating means has an operation lever provided slidably, and a connecting member provided slidably to said operation lever at the opposite side of supporting point of the operation lever, wherein an extruding rod has a extruding member fixed to its front end, and is inserted into a connecting hole formed on said connecting member, and moving the connecting member and the extruding rod as a unit by obliquely contacting the connection hole of the connecting member to the extruding rod when the operation lever is pulled.

According to the invention described herein, when opening both ends within the elasticity distortion range the clearance between both ends are larger than the minimum width of a bound portion of the material to be tied, thereby material to be tied can be guided to inside by opening both ends, and bundling of the material to be tied can be tightened and fixed by the restoration strength of the wire rod because the maximum inner diameter in a restored state is smaller than the minimum width of the bound portion of the material to be tied.

According to the invention described herein, the material (s) can be bound more securely by using the invention when binding a pair of materials to be tied. According to the invention described herein, providing an intersectional portion of crossed materials to be tied as the bound portion, the crossed materials to be tied can be bound in an intersectional state. According to the invention described herein, binding a plurality of material to be tied which are arranged in parallel and attaching these to the outside of the bound portion, thereby these can be tightened from outside and it is easy to bind them.

According to the invention described herein, both ends of an arc wire rod have a curved portion curved opposite to the curving direction of the arc thereby it is easy to insert the inserting body between both ends of the arc wire rod and the work of opening both ends against the elastic force can easily be done. According to the invention described herein, the wire rod has a rupture portion to be ruptured when a deformation value exceeds the elasticity limit, thereby the arc wire rod can easily be ruptured by expanding and exceeding the elasticity limit and the work of removing a tie from the bound portion can easily be done.

According to the invention described herein, when opening both ends of the arc wire rod, the rupture portion is located in a center portion, the position where stress is concentrated the most, thereby the tie can easily be ruptured and removed. According to the invention described herein, the rupture portion is a portion smaller in area of cross section compared to other portions, thereby the concentration of stress is further accelerated and the rupture operation can easily be done. According to the invention described herein, the rupture portion is a groove or a cut formed in a direction perpendicular to the axial direction of the wire rod, thereby the process of forming the rapture portion can be made easily.

According to the invention described herein, the wire rod is in a shape that both ends intersect in a restoration state, thereby a large distortion amount can be taken when binding and the tightening force can further be increased. According to the invention described herein, because the wire rod has a loop when both end of the tie are expanded, the length of wire rod will be longer, distortion on the wire rod is equalized and reduced, and a distortion amount (the width of both ends expanded) can further be increased. Also, the contacting portion of the tie and materials to be tied can be increased, thereby further securely binding.

According to the invention described herein, a plurality of ties can be carried as a unit by a tie assembly connecting inserting member inserted slidably between both ends of a tie through a thin walled connecting portion. Consequently, when attaching ties at a work site where a number of bound portions exist, work can be done by removing ties from the end in order, thereby working efficiency can be increased. According to the invention described herein, by operating the operation means to progress extruding member, the tie positioned in the reception space is pushed out forward. The tie is pushed open while progressing, and detached from the guiding member and attached to the materials to be tied when both ends of the tie are in a position exceeding the materials to be tied housed between the guiding member. By using such a device, attachment of the tie to materials to be tied can be made easily and quickly.

According to the invention described herein, a groove is formed on an external face of the guiding member to guide both end portions of a tie, thus, the tie can be guided to the position exceeding the front end of the guiding member. According to the invention described herein, a storing portion is provided between the guiding member and the extruding member to feed the tie into the reception space, thereby the tie can easily be loaded to the tie attachment device. According to the invention described herein, the tie assembly is housed in a storing portion and the bias member is provided in the storing portion thereby the attachment operation of the tie can be made continuously without an operation of loading one tie at a time. This increases the efficiency of the binding work.

According to the invention described herein, by sliding the operation lever, the connecting member extrudes the extruding member forward. When the connecting member moves forward, it contacts the connecting hole of the connecting member obliquely against the extruding rod, which further applies a force to move it forward, thereby the edge of the connecting hole is pressed by the extruding rod, which strengthens the connection of the extruding rod and the connecting member, and the extruding rod moves as a unit with the connecting member. Consequently, the extruding rod extrudes the extruding member and the tie is attached. The point for applying the force to slide the operation lever acts as a point of application and the connecting hole acts as a point of action. Further, adjusting the length of the operation lever generates a force to easily extrude the tie manually, and a simple and lightweight attachment device can be configured without driving equipment, such as motors.

DETAILED DESCRIPTION OF THE INVENTION

Figure 1:
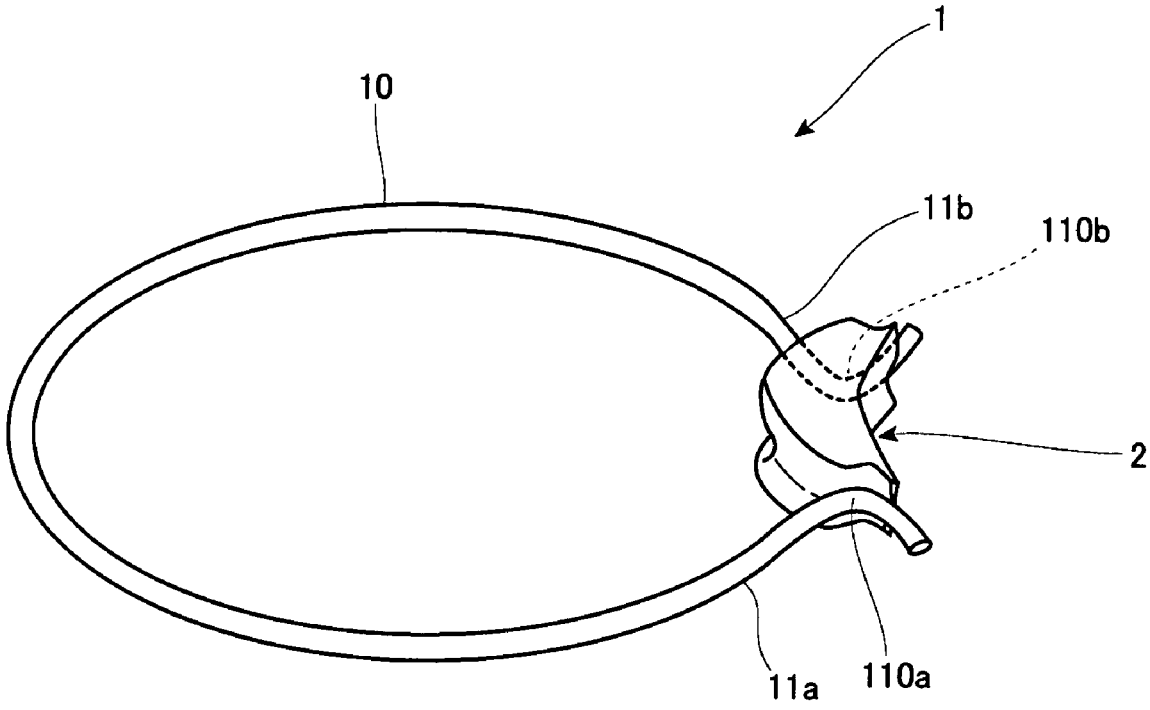
FIG. 1 is an overall perspective view showing a tie.
Figure 2:
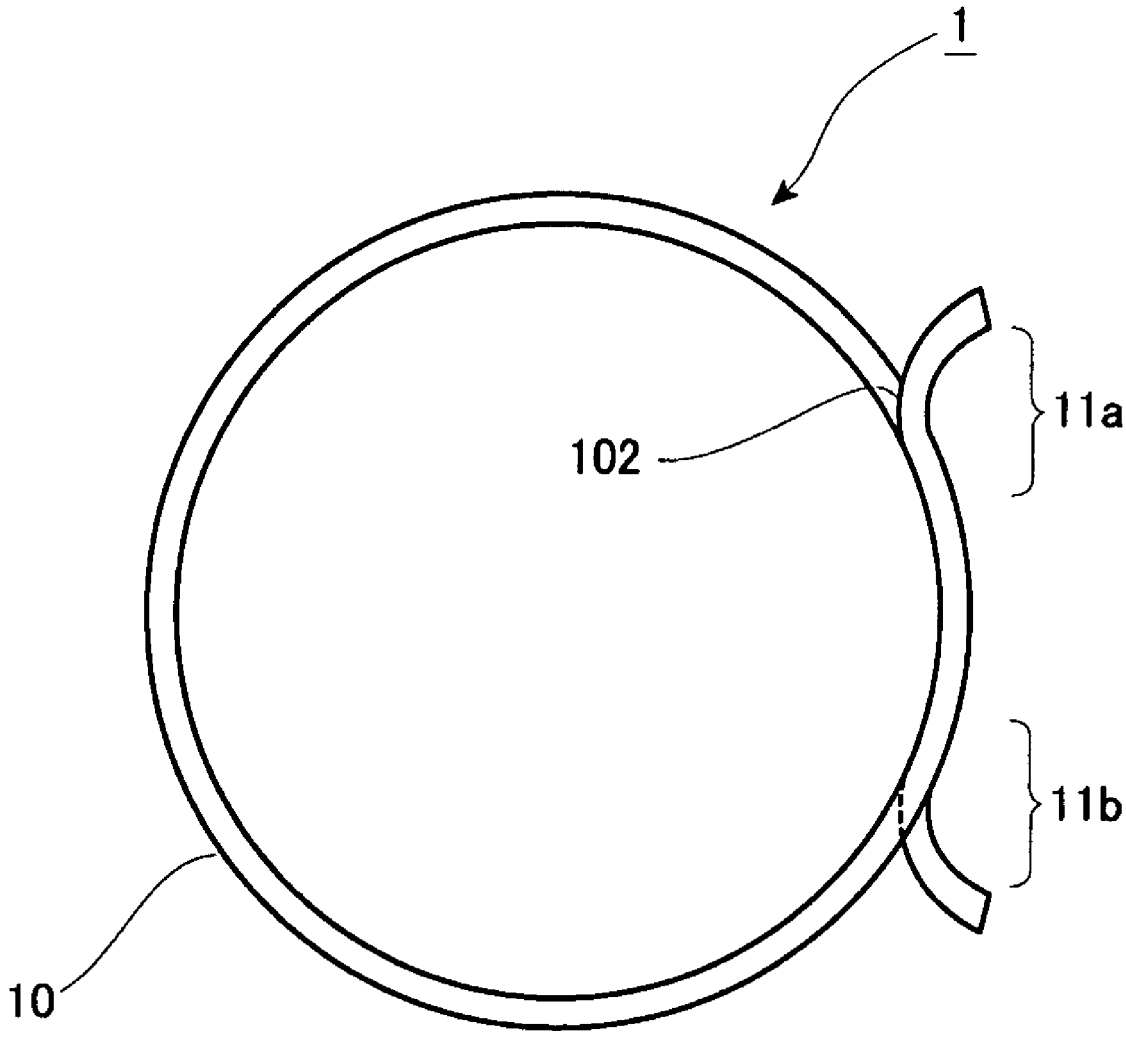
FIG. 2 is an overall plane view of a tie in a restored state.

Detail of embodiments according to the present invention is hereinafter explained referring to the drawings. FIG. 1 is an overall perspective view of a tie according to present invention, and FIG. 2 is an overall plane view of a tie in a restored state. The tie 1 is configured by forming a wire rod 10 consisting of elastic material in a generally tonic shape, and a metal spring material is used as an elastic material. In this embodiment, a cross section of the wire rod 10 is formed in a circular form and end portions alternately overlapping each other and forming a toric shape when in a non-deformed state (restored state) as shown in FIG. 2.

Both end portions 11*a* and 11*b* of the wire rod 10 having curved portions 110*a* and 110*b* curved opposite to the curving direction of the wire rod 10, and an inserting member 2 is inserted between the curved portions 110*a* and 110*b* in a loaded state as shown in FIG. 1. The inserting member 2 pushes open both ends of wire rod 10, forming a clearance between the curved portions 110*a* and 110*b* while the wire rod 10 is in an elastic deformation state. Therefore, when the inserting member 2 is removed from the tie 1 with inserting member 2 inserted, a force to return to the restored state is acting. Also, a suppressed stress is consistently acting from the curved portions 110*a* and 110*b* in a direction to sandwich and attempt to crush the inserting member 2.

Figure 3:
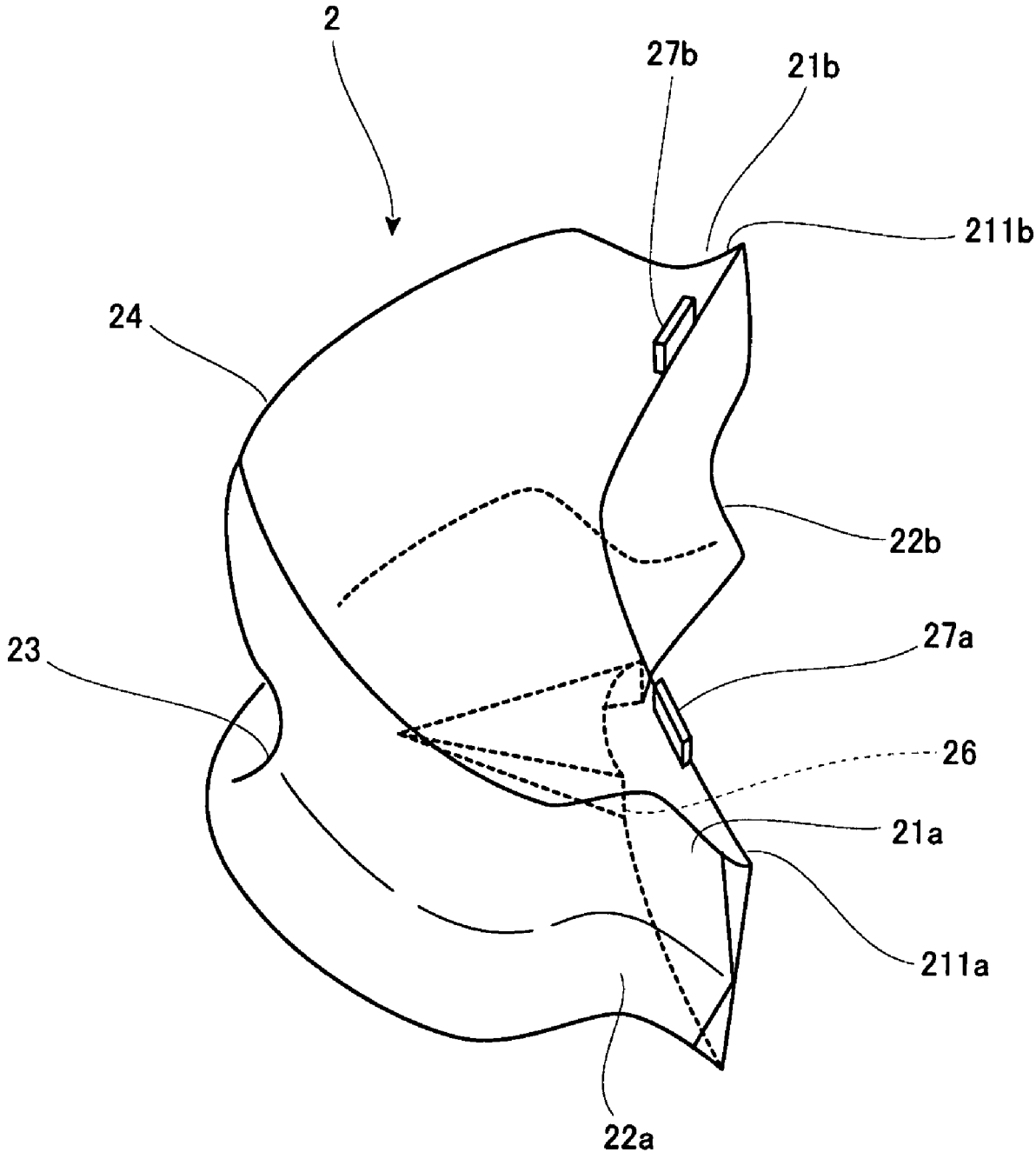
FIG. 3 is an enlarged perspective view of an inserting member.
Figure 4:
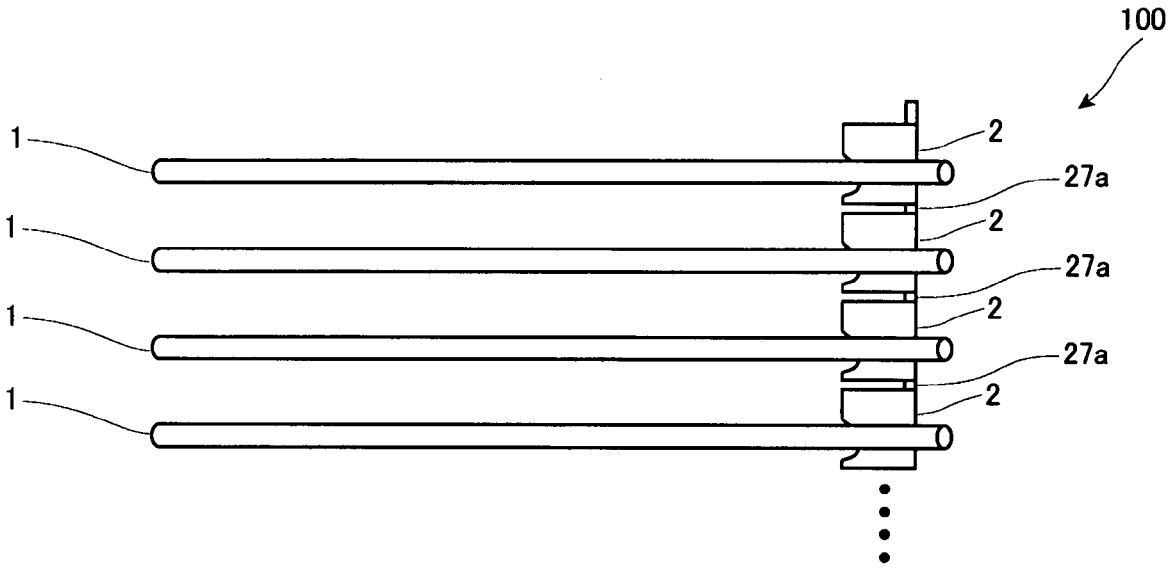
FIG. 4 is a side view showing a tie assembly.

FIG. 3 is an enlarged perspective view of the inserting member 2, and FIG. 4 is a side view of the tie assembly 100. The inserting member 2 is a plate form member having a thickness longer than the length of the wire rod 10 of tie 1, and the side face of both ends contact the curved portions 110*a* and 110*b* are provided with depressed portions 21*a* and 21*b* having curvatures according to the curves of curved portions 110*a* and 110*b*. Also, a groove 23 is formed in a circumferential direction on the side face of inserting member 2, and both ends of the groove are connected to curved portion grooves 22*a* and 22*b* from the depressed portions 21*a* and 21*b*. The groove 23 and the curved portion grooves 22*a* and 22*b* are formed in a shape corresponding to the cross section shape of wire rod 10. Also, the groove 23 is formed on a position closer to one of the upper face 211*a* or lower face 211*b* (one side) in the thickness direction of the inserting member 2.

When attached to the tie 1, the groove 23 is formed on a side face 24, the side of the tie 1 is positioned, and the side face 24 is formed in a convex along the curve of the tie 1. Also, on a plane of the side where the groove 23 is formed, a fit portion 26 in a depressed shape that the rear end of a guiding member (described later) to be engaged, is formed. This fit portion 26 is formed to conform to the rear end portion of the guiding member, and in a shape that the width and the depth gradually decreases so that the opening portion is the deepest. Connecting portions 27*a* and 27*b* are provided to front end side end portions of the upper 211*a* and lower 211*b* faces of the inserting member 2, and by these connecting portions 27*a* and 27*b*, inserting members 2 layered in the thickness direction are alternately connected. The connecting portions 27*a* and 27*b* are specially formed as thin-walled, and configured to be able to be ruptured with a small shear stress.

Figure 5:
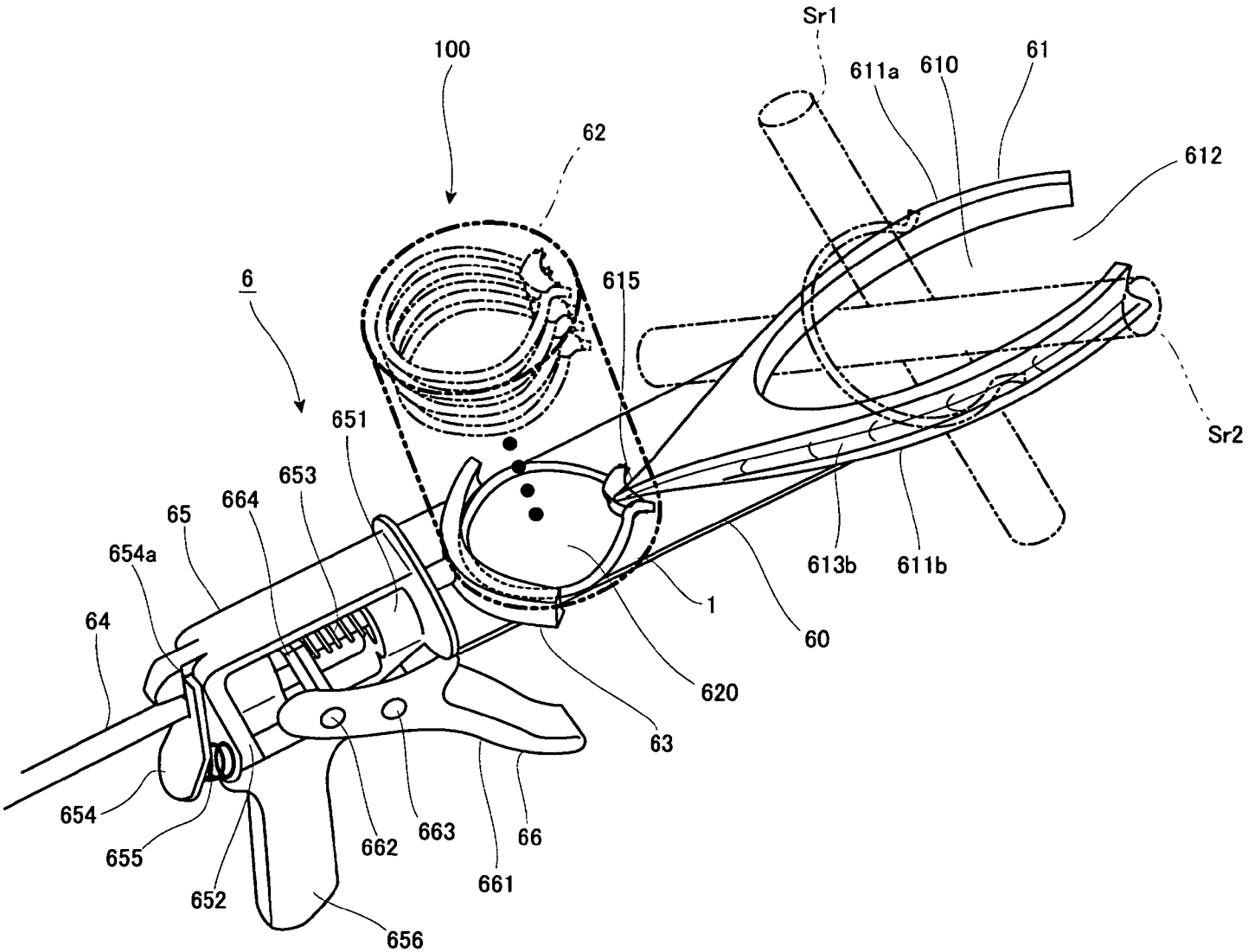
FIG. 5 is an overall perspective view of a tie attachment device.
Figure 6:
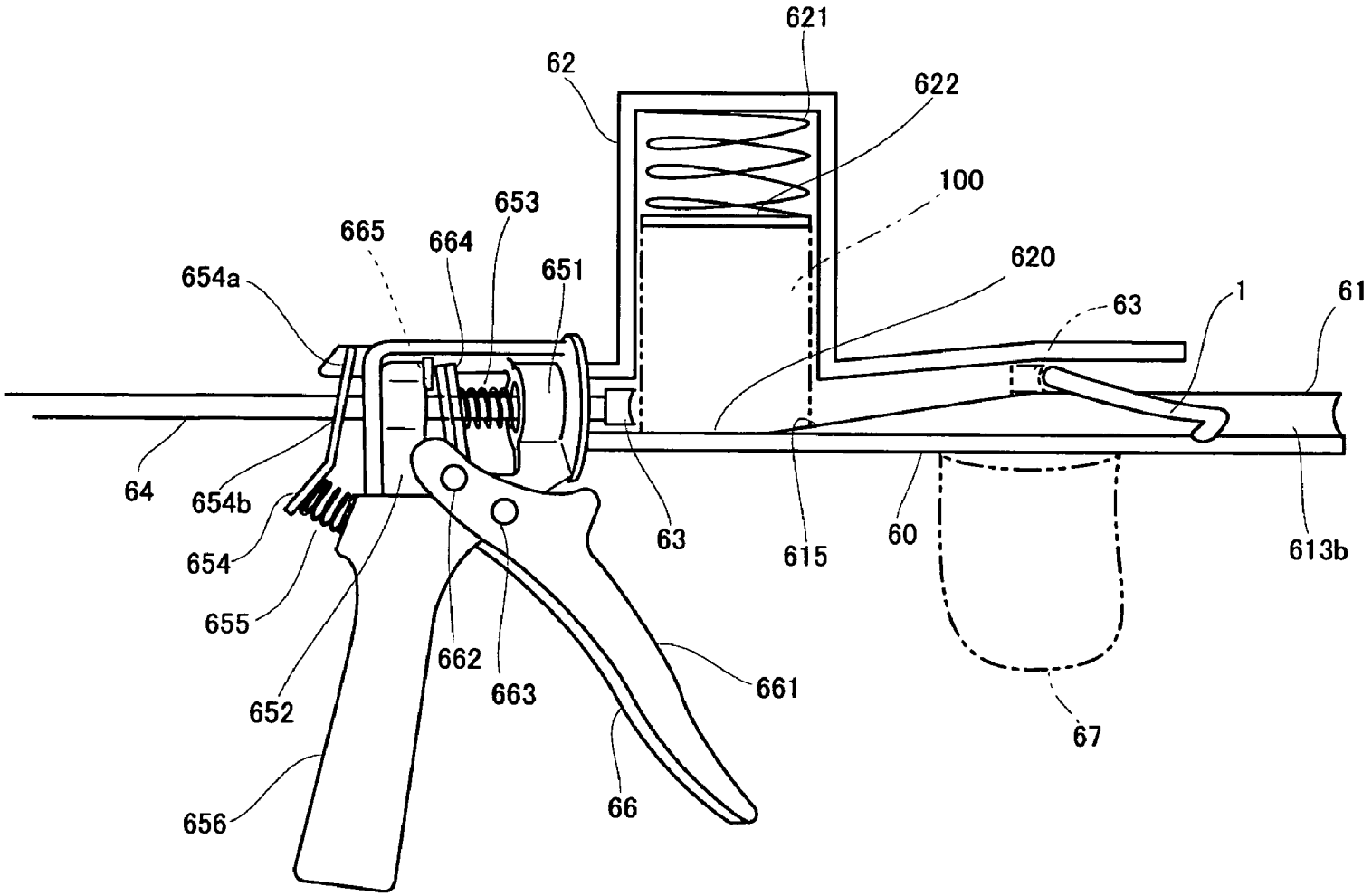
FIG. 6 is an overall side view of a tie attachment device.

As shown in FIG. 4, a plurality of inserting members 2 are serially coupled by the connecting portions 27*a* and 27*b*, and the ties 1 are attached to each inserting member 2. In this way, a tie assembly 100 is configured. The inserting members 2 configured as above consist of, for example, a synthetic resin. FIG. 5 is an overall perspective view of a tie attachment device 6, and FIG. 6 is an overall side view of the same. The tie attachment device 6 is provided with a guiding member 61 which guides the tie 1 so as to fit outside of the binding portion of the reinforcing bars while opening the tie 1, a storing portion 62 positioned posterior to the guiding member 61 to store the tie 1, an extruding member 63 positioned posterior to the storing portion 62, an extruding rod 64 having the extruding member 63 fixed to its front end, a main body 65 to support the extruding rod 64 so as to move freely in an antero-posterior direction, an operation lever 66 slidably supported by the main body 65, and a connecting member 664 having a connecting hole 665 in which the operation lever 66 is inserted.

The guiding member 61 has guiding portions 611*a* and 611*b* that respectively press curved portions 110*a* and 110*b* on both ends of the tie 1 from outside. The guiding portions 611*a* and 611*b* are connected at their rear ends (back ends) and are configured to form a gradually increasing space 610 toward their front ends to gradually increase the clearance between the curved portions 110*a* and 110*b* on both ends of the tie 1. As shown in FIG. 5, the gradually increasing space 610 is formed between the guiding portions 611*a* and 611*b*. The guiding member 61 is fixed on a base material 60 protruding anterior to the main body 65, and onto the base material 60, a reception space 620 to be described later is provided between the main body 65 and the guiding member 61. The intersectional portion (bound portion) of a vertical reinforcement Sr1 and a horizontal reinforcement Sr2 is housed in the gradually increasing space 610, and between the top ends of guiding portions 611*a* and 611*b* is an opening 612 for bringing the reinforcing bars into the gradually increasing space 610.

Outer side faces of each guiding portion 611*a* and 611*b* are guiding faces that contact the curved portions 110*a* and 110*b* of tie 1 and guide in a way that twist around a reinforcing bar inside the gradually increasing space 610 while pressing open the curved portions 110*a* and 110*b*, and grooves 613*a* (not shown) and 613*b* formed to this guiding face along the axial direction of the guiding portions 611*a* and 611*b*. One side (lower side in FIG. 5) of grooves 613*a* (not shown) and 613*b* is formed higher and the other side (upper side in FIG. 5) is formed lower, and configured to position the main body of wire rod 10, from the tie 1, to the side that is formed lower.

The grooves 613*a* (not shown) and 613*b* are provided to the guiding portions 611*a* and 611*b* continuously from the rear end to the top end. In the back end portion of the guiding member 61, the guiding portions 611*a* and 611*b* are integrated, with the height and width gradually decreasing towards the posterior, and the rear end is formed in an acute angle. To this rear end, the inserting member 2 of loaded tie 1 is layered, and the fit portion 26 of inserting member 2 is fitted to the rear end portion 615 of guiding member 61. A reception space 620 is provided posterior to the guiding member 61 to house the tie 1, further, the extruding member 63 is provided posterior to the reception space 620. The extruding member 63 is formed in an arc along the curve of wire rod 10, and a groove 631 (not shown) is formed to place the tie 1 inside. By this groove 631 (not shown), the tie 1 is prevented from separating from the extruding member 63.

Also, the curvature of extruding member 63 is formed to conform to the curvature of wire rod 10 when the tie 1 is pressed open to the maximum by the guiding member 61 as described later, instead of the curvature of tie 1 when housed inside the reception space 620. The top end of extruding rod 64 is connected posterior to the extruding member 63, and the extruding rod 64 supports the extruding member 63 so as to move freely in an antero-posterior direction. The extruding member 63 contacts the main body 65, and being slidably supported in an axial direction by said main body 65. The main body 65 is provided with a front support portion 651 and a back support portion 652 that slidably support the extruding rod 64, and a grip portion 656 projected in a direction almost perpendicular to the extruding rod 64.

The inserting hole to insert the extruding rod 64 formed on the front supporting portion 651 is formed sufficiently larger than the diameter of extruding rod 64, and a play occurs between the inserting hole and the extruding rod 64. A plate-shaped lock member 654 is provided posterior to the back supporting portion 652. One end of the lock member 654 is slidably supported by the main body 65, and a inserting hole 654*a* is formed in center portion to insert the extruding rod 64. A compression spring 655 is inserted between the other end of lock member 654 and the main body 65.

The lock member 654 is maintained by the compression spring 655 in a position against the extruding rod 64. At this time, the edge of inserting hole 654*b* touches the side face of extruding rod 64 and maintains the extruding rod 64 to be incapable of sliding backwards, thereby locking the backward movement of extruding rod 64. This lock is released by pressing in the lock member 654 against the compression spring 655 and positioning perpendicular to the extruding rod 64, thereby the extruding rod 64 is in a state capable of moving backwards.

The operation lever 66 is slidably supported pivotally at a supporting point 663 to the front side of grip portion 656, and the handle portion 661 is configured to approach and depart to/from the grip portion 656. The connecting member 664 is slidably supported pivotally to the end portion on the opposite side of the grip portion 661 centering on the supporting portion 663 through the supporting point 662. In the center of connecting member 664, a connecting hole 665 is formed to insert the extruding rod 64, and the diameter of connecting hole 665 is formed to be slightly larger than that of extruding rod 64. Also, the compression spring 653 is inserted between the connecting member 664 and front supporting portion 651 which biases the connecting member 664 in a posterior direction.

In such configuration, the supporting point 662 is extruded forward when sliding the operation lever 66 to the grip portion 656. By the movement of supporting point 662, the connecting member 664 slants to the extruding rod 64, thereby the edge of connecting hole 665 contacts the side face of extruding rod 64. This contact increases a friction coefficient of the connecting hole 665 and extruding rod 64, and the extruding rod 64 and connecting member 664 move forward as a unit against the biasing force of compression spring 653. When returning the operation lever 66 to the original position, the connecting member 664 is in a position almost perpendicular to the extruding rod 64 by the biasing force of compression spring 653, thereby contacting the edge of the connecting hole 665 and the extruding rod 64 is released and only the connecting member 664 returns to the original position. Also, on the upper side of reception space 620, reception portion 62 is provided to house a tie assembly 100, the housed tie assembly 100 is pushed into the reception space 620 by the spring 621 as a biasing member provided between the inner wall of reception portion 62 and the feeding member 622.

In addition, a bursiform collecting portion 67 is provided beneath the gradually increasing space 610 having an opening toward said gradually increasing space 610. The collecting portion 67 receives inserting member 2 dropped from the gradually increasing space 610 in its inside and collects them. In the tie assembly 100, the tie 1 positioned undermost is positioned in the reception space 620. The fit portion 26 of inserting member 2 fits into the rear end portion 615 of guiding member 61 and the tie 1 in the reception space 620. When the tie 1 inside the reception space 620 is extruded forward by the extruding member 63, first, the curved portions 110*a* and 110*b* detach from the depressed portions 21*a* and 21*b* of inserting member 2, and move into the grooves 613*a* and 613*b* provided on the guiding portions 611*a* and 611*b* of guiding member 61.

When the extruding member 63 is further extruded forward, the tie 1 progresses while the curved portions 110*a* and 110*b* are pressed open right and left by the guiding portions 611*a* and 611*b*. Next, the rear end portion of wire rod 10 contacts the inserting member 2, and the wire rod 10 fits within the groove 23 of inserting member 2, thereby further extruding inserting member 2 forward. At this time, connecting portions 27*a* and 27*b* connected adjacent to inserting portion 2 in the tie assembly 100, and the undermost inserting member 2 is detached from the tie assembly 100.

Figure 7:
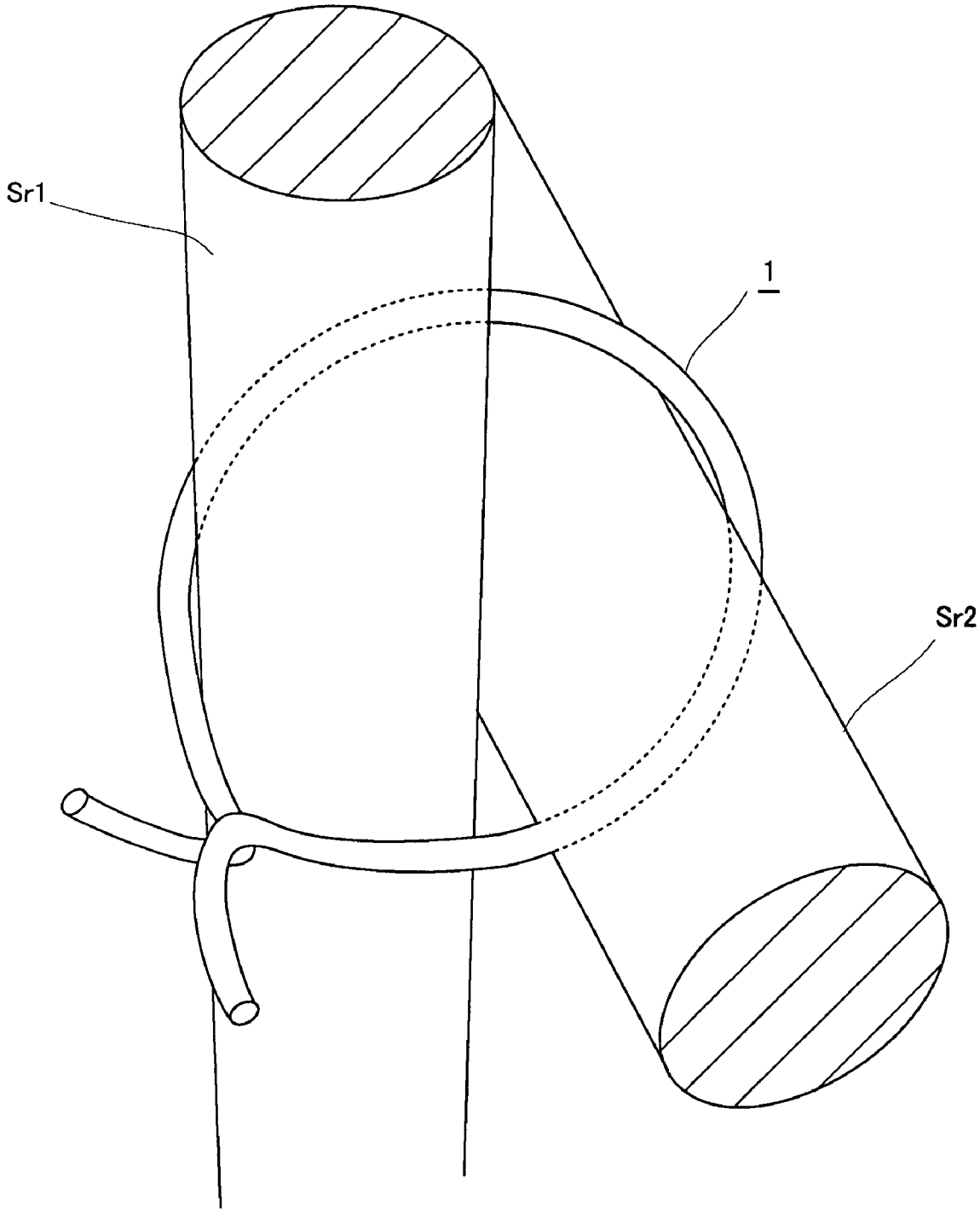
FIG. 7 is a perspective view showing a state when the tie is attached.

The detached inserting portion 2 moves along with tie 1, drops downward as it reaches the gradually increasing space 610, and is collected in the collecting portion 67. Meanwhile, the bound portion which is an intersection of the horizontal reinforcement Sr2 and the vertical reinforcement Sr1, is positioned within the gradually increasing space 610, and the curved portions 110*a* and 110*b* of tie 1 guided by the guiding member 61 so as to go around outside the bound portion. As the curved portions 110*a* and 100*b* of tie 1 reach the top end of guiding member 61, the tie 1 detaches from the guiding member 61, decreases its diameter by the restoration force of the wire rod 10, and attaches to the bound portion which is an intersection of the vertical reinforcement Sr1 and horizontal reinforcement Sr2, as shown in FIG. 7.

The tie 1 is configured such that the inner diameter in the restored state as shown in FIG. 2 is smaller than the sum of diameters of binding horizontal reinforcement Sr2 and vertical reinforcement Sr1, and the distance between the curved portions 110*a* and 110*b* is larger than the sum of the diameters of binding horizontal reinforcement Sr2 and vertical reinforcement Sr1 when expanded within the elasticity limit of wire rod 10. In addition, in order for the tie 1 to be able to be easily removed after the attachment, the tie 1 can be configured such that a groove or a cut is formed on the center portion, thereby it can easily be plastically deformed or ruptured at the groove or cut when deformed to exceed an elasticity limit. In this case, the rupture portion configured by forming a groove or a cut may be a site where the form of the wire rod 10 in the axial direction is discontinuous, or it may be a site where an area of cross section is smaller compared to other portions. Alternatively, it may be a site with a different composition. The site with the different composition can be provided by applying treatment different from other parts, such as quenching, annealing, or shot-peening.

Figure 8:
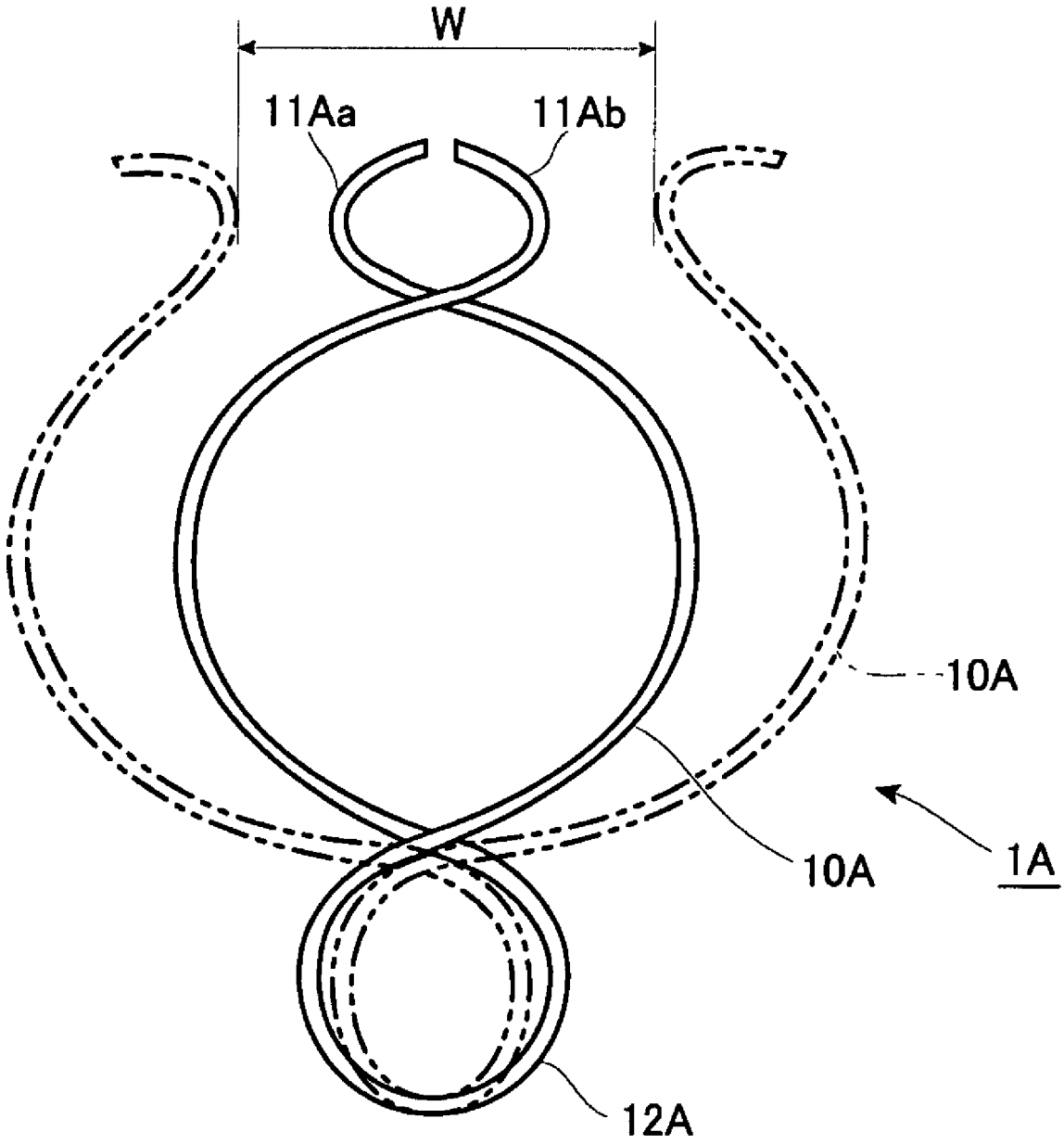
FIG. 8 is an overall plane view showing a tie in another configuration.

FIG. 8 is a plane view showing a tie 1A having loop 12*a* formed on a center position of the wire rod 10A. The loop 12A is an annular section formed outside by curving the wire rod 10A opposite to the main body portion formed in an arc. By providing the loop 12A, distortion on the wire rod 10A which occurs when opening both end portions 11*a* and 11*b*, can be even equalized and decreased as a whole thereby a larger opening W of both end portions 11Aa and 11Ab can be realized. This enables use of a smaller wire rod.

Figure 9:
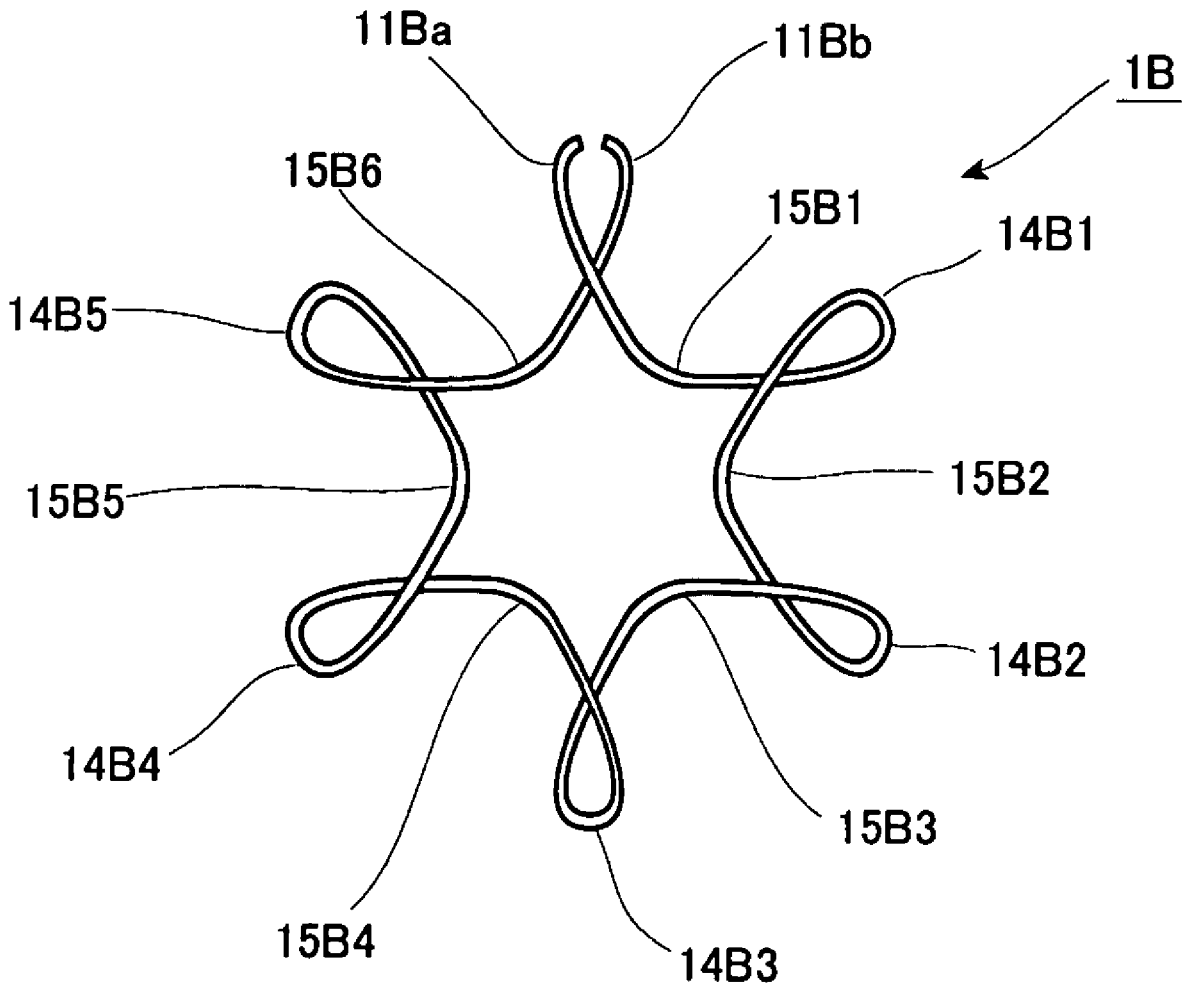
FIG. 9 is an overall plane view showing a tie in another configuration.
Figure 10:
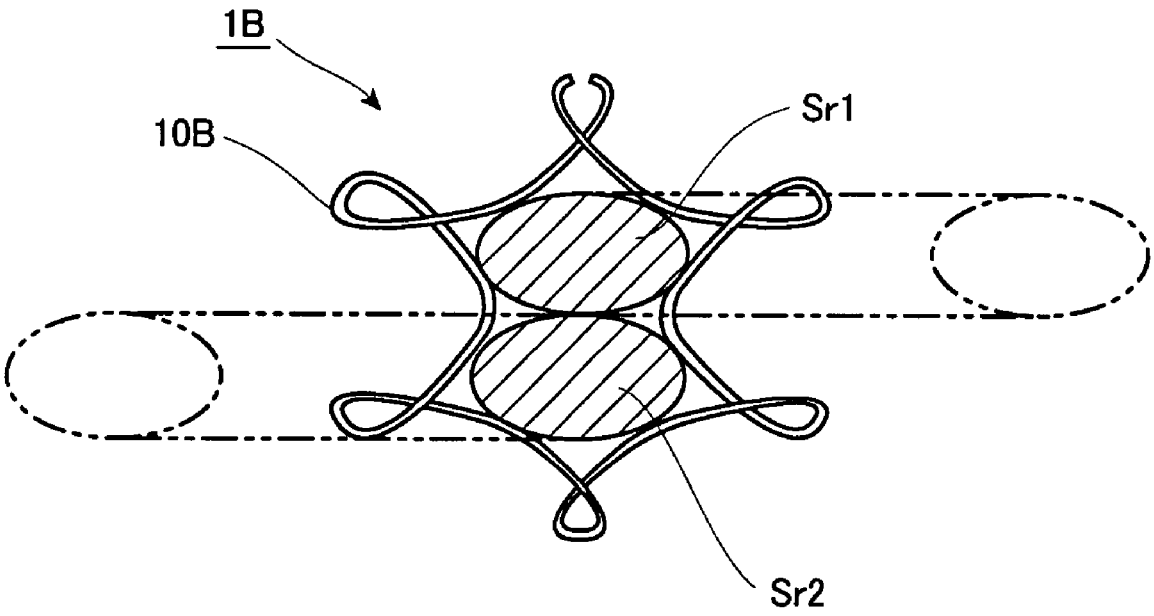
FIG. 10 is a plane view of a tie showing a state of attachment to a bound portion.

The tie 1B shown in FIG. 9 has a plurality of loops 14B1-14B5 at even intervals, and contacting portions 15B1-15B6 are provided in-between these loops 14B1-14B5. For this tie 1B, the clearance of both ends 11Ba and 11Bb can also be widened when deformed, and each contacting portion 15B1-15B6 can be in pressure contact against intersectional reinforcing bars as shown in FIG. 10, thereby increasing contacting portions against the reinforcing bars. This increases the binding strength of the bound portion.

Figure 11:
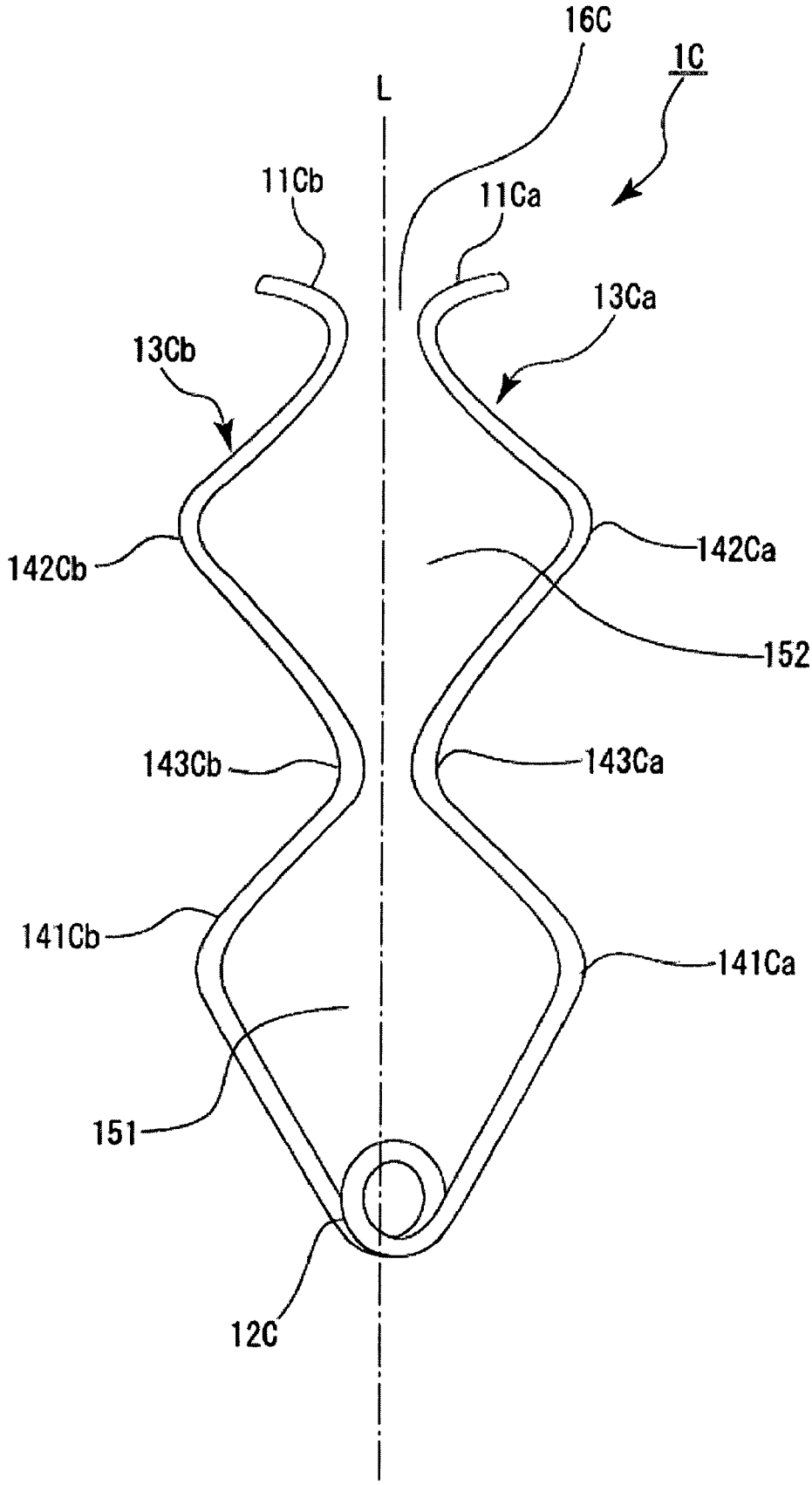
FIG. 11 is an overall plane view of another configuration example of a tie.

FIG. 11 is an overall plane view of another configuration example of a tie. A tie 1C has a loop 12C on the center of a wire rod, and wire rods 13Ca and 13Cb on both sides of the loop are formed in line symmetrical across a center line L which runs through the loop 12C. That is, the wire rods 13Ca and 13Cb are formed by extending a pair of wire rods which is parallel in a same direction with reference to the loop 12C as a base end, towards a direction away from the center line L, curving it to the direction of center line L at the curved portions 141Ca and 141Cb, and curving outward (direction away from the center line L) at the curved portions 143Ca and 143Cb on the top end side of curved portion 141Ca and 141Cb, further curving towards the center line L at the curved portion 142Ca and 142Cb on the top end side. The wire rods 13Ca and 13Cb are configured with an elastic material as the tie in the embodiments described above. Top end portions 11Ca and 11Cb of each wire rod 13Ca and 13Cb are curved outward and configured to slide and contact easily to the grooves 613*a* and 613*b* of guiding member 61. As described above, in the tie 1C, the wire rods 13Ca and 13Cb on left and right are in line asymmetry wave forms, thus reception retention portions 151 and 152 are formed between the wire rods 13Ca and 13Cb to house a horizontal reinforcement and a vertical reinforcement respectively. Each of the reception retention portions 151 and 152 according to this embodiment are in virtually rectangle forms and in the forms that retain horizontal reinforcement and vertical enforcement respectively, thereby increasing contact portions of the horizontal reinforcement and the vertical reinforcement with the wire rods 13Ca and 13Cb, which improves the retaining force. Also, the form of each reception retention portion 151 and 152 is not limited to a rectangle, and may be in other polygonal shapes or a circular shape.

What is claimed is:

1. A tie attachment device for placing a tie around a bound portion of at least two members to be tied, the tie attachment device comprising:

a guiding member comprising a pair of guiding portions for gradually increasing a clearance distance between at least two opposite ends of the tie, wherein:

the pair of guiding portions are configured to form an acute angle at their respective rear ends while a gradually increasing space toward their front ends is formed therebetween for surrounding the bound portion of at least two members to be tied;

the tie comprises a wire rod made of elastic material formed in an arc shape where the clearance distance between at least two opposite ends of the tie is larger than a minimum width of the bound portion of at least two members to be tied, and a maximum inner diameter in a restored state is smaller than a maximum width of the bound portion of at least two members to be tied;

an extruding member positioned posterior to said guiding member for extruding the tie;

an operation means for advancing said extruding member;

wherein said extruding member is capable of reciprocal motion between a standby position and an attachment position;

wherein a tie assembly is housed in a storing portion to store a plurality of ties, wherein a plurality of inserting members, each inserted between at least two opposite ends of one of the plurality of ties, are serially coupled to the tie assembly through a thin-walled connecting portion, and a biasing member provided in said storing portion for biasing said tie assembly toward a reception space.

2. The tie attachment device according claim 1, wherein a groove for guiding both end portions of the tie is formed on an outer face of said guiding member.

3. The tie attachment device according to claim 1, wherein said storing portion is positioned between said guiding member and said extruding member for storing the plurality of ties and feeding an undermost tie to the reception space.

4. The tie attachment device of claim 1, wherein said operating means comprises;

an operation lever; and a connecting member positioned at a side of a supporting point of the operation lever;

wherein an extruding rod having a extruding member fixed to its front end is inserted into a connecting hole formed on said connecting member, and moves the connecting member and the extruding rod as a unit by contacting the connecting member when the operation lever is pulled.

* * * * *